US006438879B1

(12) United States Patent
Kao

(10) Patent No.: US 6,438,879 B1
(45) Date of Patent: Aug. 27, 2002

(54) ILLUMINATED STAND FOR ARTIFICIAL TREE

(75) Inventor: Cheung Chong Kao, Hong Kong (HK)

(73) Assignee: Boto (Licenses) Limited, Chai Wan (HK)

( * ) Notice: Subject to any disclaimer, the term of this patent is extended or adjusted under 35 U.S.C. 154(b) by 0 days.

(21) Appl. No.: 09/495,920

(22) Filed: Feb. 2, 2000

(51) Int. Cl.[7] ..... G09F 13/00
(52) U.S. Cl. ..... 40/431; 362/568
(58) Field of Search ..... 40/431, 430, 455, 40/456, 457, 473, 406, 427, 429; 362/568, 581, 567

(56) References Cited

U.S. PATENT DOCUMENTS 2,279,182 A * 4/1942 Snyder ..... 40/431
2,364,786 A * 12/1944 Hall ..... 40/473
2,791,998 A * 5/1957 Decker ..... 40/431
3,465,139 A * 9/1969 Siegal ..... 40/431
5,104,608 A * 4/1992 Pickering ..... 362/568
5,829,863 A * 11/1998 Gutshall ..... 362/568
6,056,427 A * 5/2000 Kao ..... 362/581

* cited by examiner

*Primary Examiner*—Stephen T. Gordon
*Assistant Examiner*—Jason Marrow
(74) *Attorney, Agent, or Firm*—Dorsey & Whitney LLP

(57) ABSTRACT

A stand (8) for supporting an artificial tree of a type having a plurality of optical fibers comprises: a housing (4) having a base (3) and a sidewall defining one or more windows (6), a screen (9) in each window (6), an internal light source (54), a decorative image-bearing material (38) or shape arranged between the light source and the screen, and a tree trunk supporting sleeve (20).

16 Claims, 12 Drawing Sheets

ILLUMINATED STAND FOR ARTIFICIAL TREE

BACKGROUND OF THE INVENTION

The present invention relates to an illuminated stand for an artificial tree such as a Christmas tree.

It is known to provide artificial trees such as Christmas trees with optical fibres which generally extend up the trunk and along tree branches, the distal ends of the fibres producing a decorative eye-catching effect when illuminated. The light source is usually contained in a stand for the tree, being upwardly directed at the proximal ends of the branches of fibres.

The present invention seeks to provide a stand for such an artificial tree also of decorative and eye-catching appearance.

SUMMARY OF THE INVENTION

According to a first aspect of the present invention there is provided a stand for supporting an artificial tree of a type having a plurality of optical fibres, the stand comprising a housing, a trunk supporting member which, in use, receives the end of the trunk of a tree, an internal light source in the housing, one or more screens supported on the housing and a decorative image-carrying medium between the light source and the screen or screens.

The image-carrying medium may be a sheet of transparent material bearing a decorative image, or may be a simple decorative shape which thereby casts a shadow on the screens.

The image-carrying sheet may be supported on a rotating member such as a wheel, so that the image moves over the screens, and with the sheet supported at the periphery of the wheel. The wheel may have a plurality of protrusions at its outer periphery which fit into corresponding openings in the sheet.

The screens are preferably formed of light translucent material having a frosted light-diffusing surface.

The trunk supporting member may be mounted for rotation and driven by a motor operatively connected thereto so as to drive this in rotation, which may also drive the rotating member supporting the image-carrying sheet.

A single light source may be used to illuminate both the trunk-supporting member and the image-carrying medium.

The stand may also be provided with a music-generating electronic circuit or processor, and electronic sound recording and playing circuit or processor.

BRIEF DESCRIPTION OF THE DRAWINGS

An embodiment of the invention will now be described, by way of example only, with reference to the following drawings in which.

DESCRIPTION OF THE PREFERRED EMBODIMENT

Figure 1:
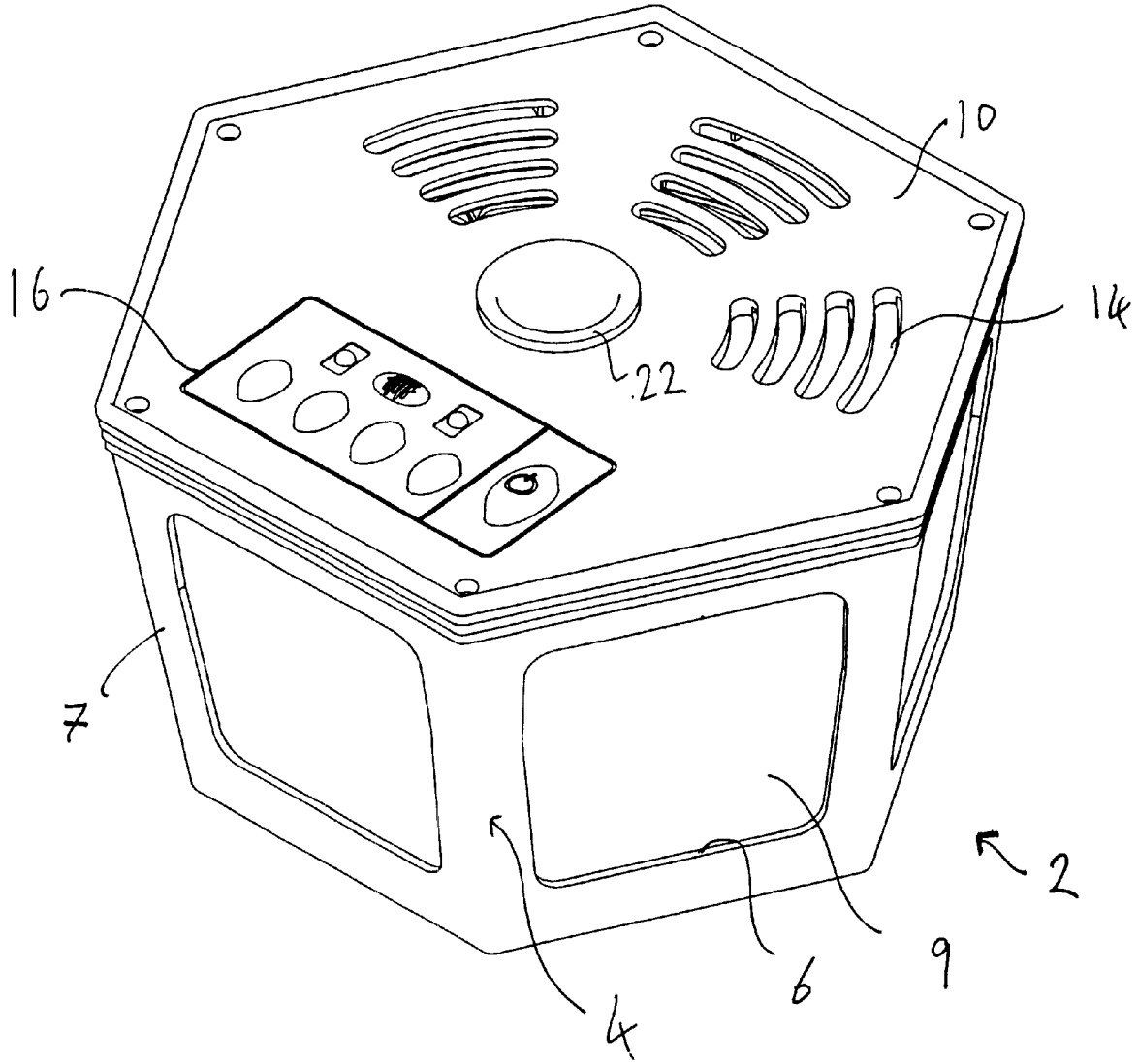
FIG. 1 shows the stand of an embodiment of the invention.
Figure 2:
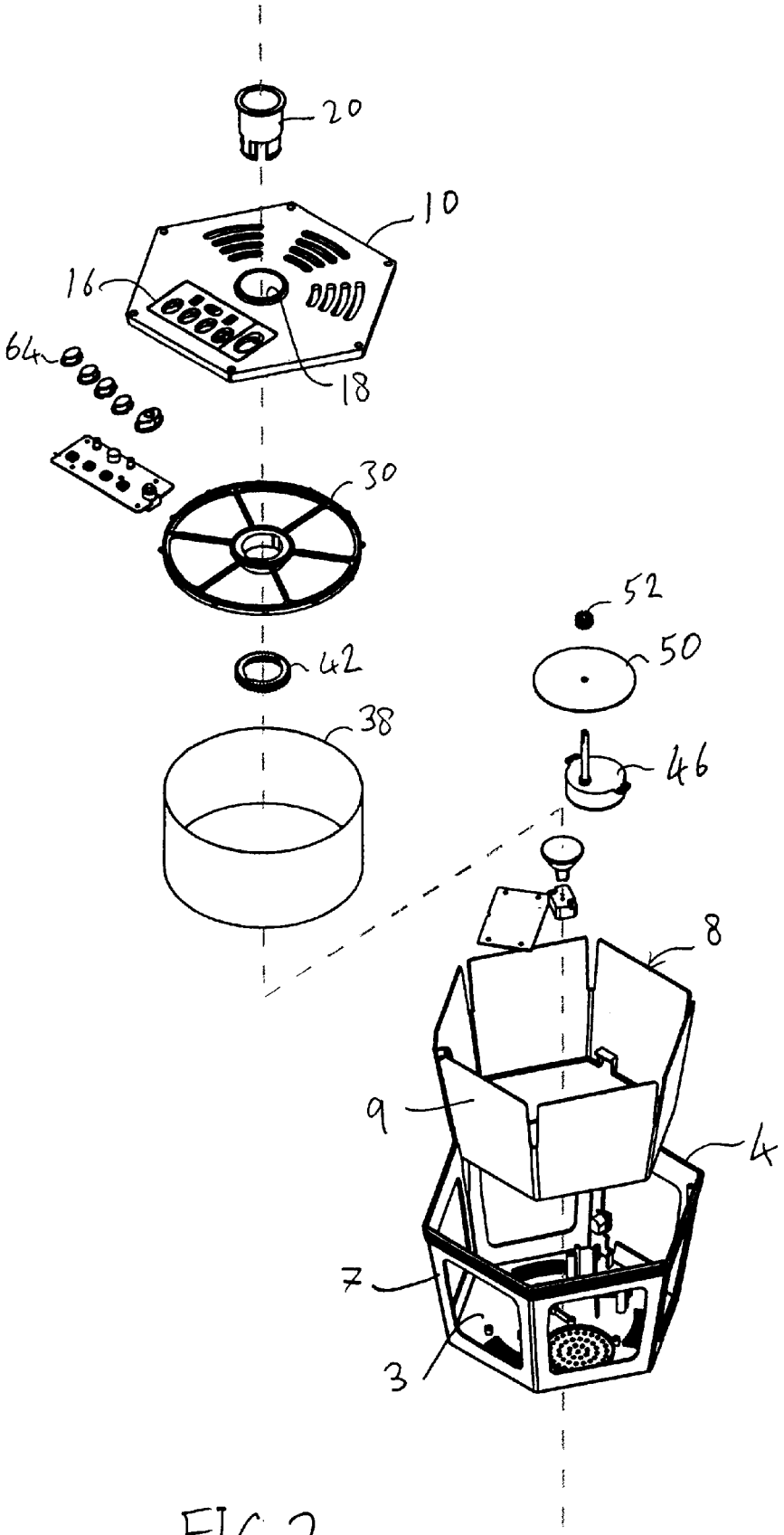
FIG. 2 is an exploded view of the stand.
Figure 3:
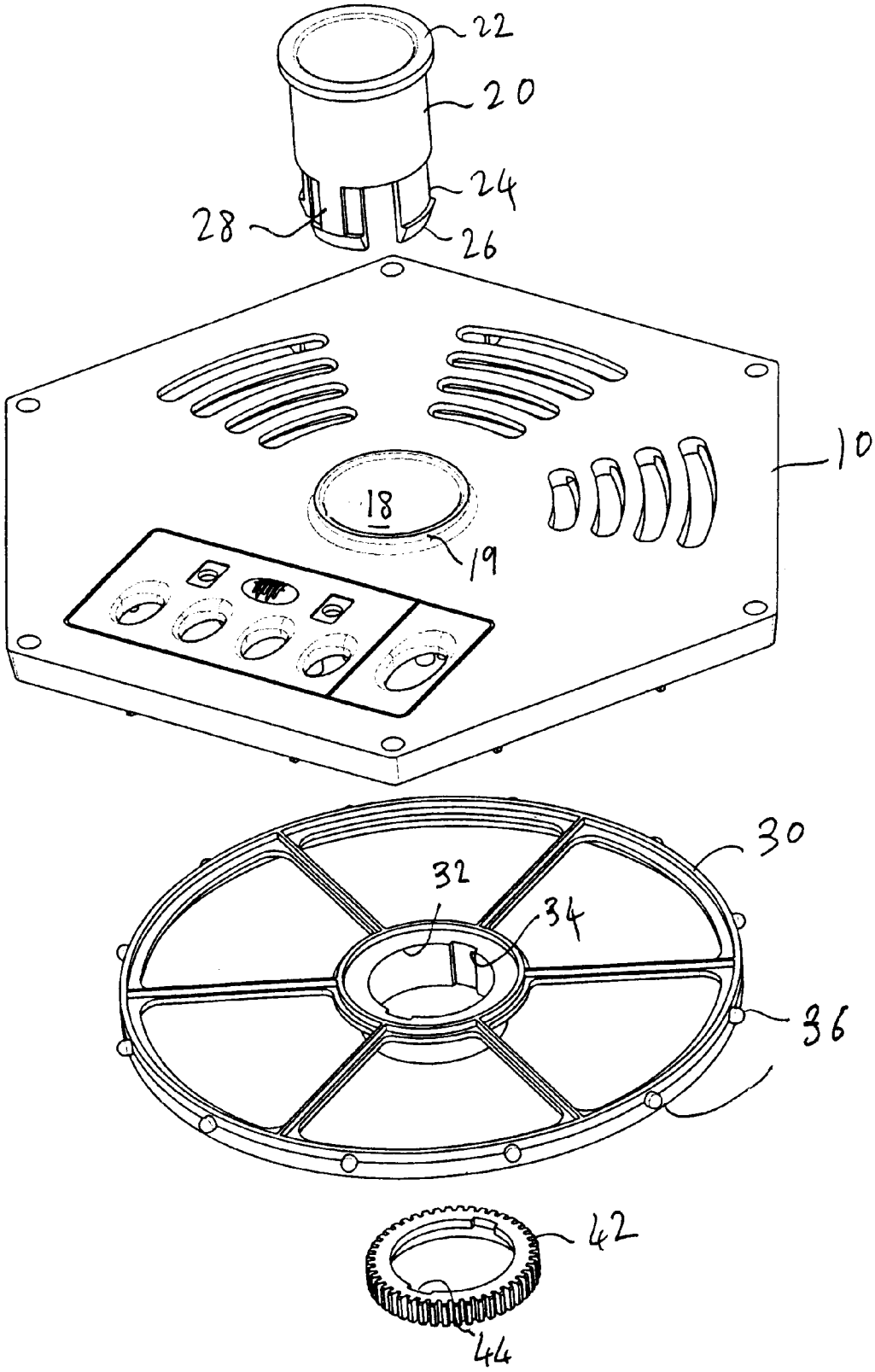
FIG. 3 is an exploded view of a trunk supporting member, housing top plate and film support.
Figure 4:
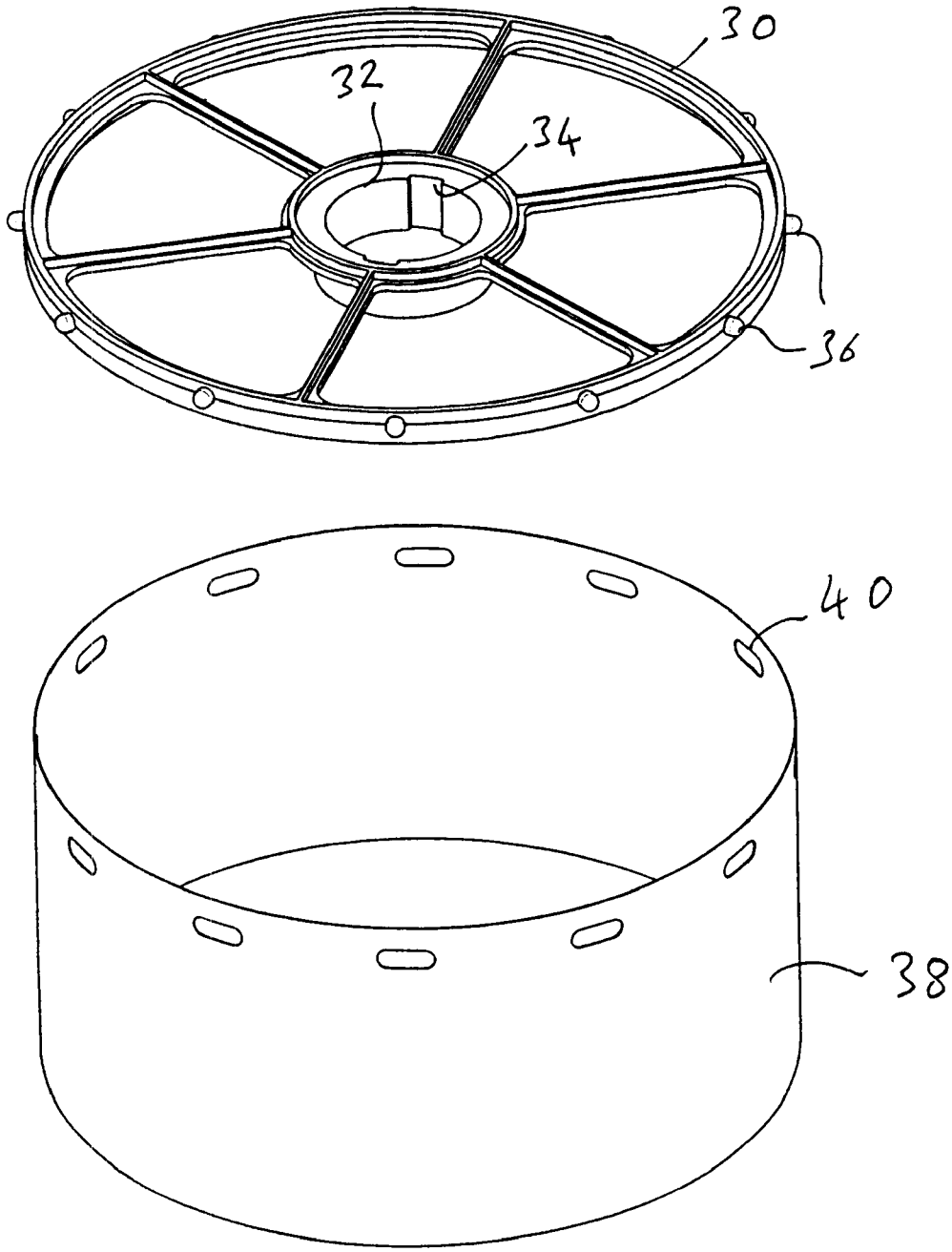
FIG. 4 is an exploded view of an image-bearing film and a support ring therefor.

An illuminated stand 2 in accordance with an embodiment of the invention is illustrated in its assembled form in FIG. 1 of the drawings. As best seen in the exploded view of FIG. 2, the stand 2 comprises a housing frame 4 having a hexagonal base 3 and upstanding side wall 7 having six identical faces each defining an opening 6 which constitutes a window. Within the frame 4 is a generally tubular member 8 of corresponding hexagonal form to the frame 4 comprising a series of connected screen pieces 9 each of substantially planar form. The screen pieces 9 are preferably of translucent material or provided with "frosted" finish in order to diffuse the light from an internal light source as discussed in further detail below. The stand 2 has a hexagonal top plate 10 which is removably fitted onto the frame 4 and secured by means of screws which fit into protruding pillars 12 upstanding on the frame 4. The top plate 10 is provided with a plurality of arcuate openings 14 which serve to allow heat generated by an internal light source and other electrical and electronic components to escape.

The top plate 10 also carries a control panel 16 as further discussed below. A central opening 18 is provided in the plate 10 with a small upstanding rim 19 surrounding the opening.

Arranged within the stand is a drive assembly to drive rotation of a central sleeve 20 which supports the bottom of an artificial tree (not shown) and to drive the rotation of an image-carrying transparency 38. More specifically, there is provided a tubular sleeve 20 having at its upper end a flange 22. At the lower end of the sleeve 20 are four depending fingers 24 terminating at their lowermost ends with enlarged portions 26 which taper towards their lower ends, one oppositely-disposed pair of fingers 24 being provided with axially extending ribs 28.

Figure 5:
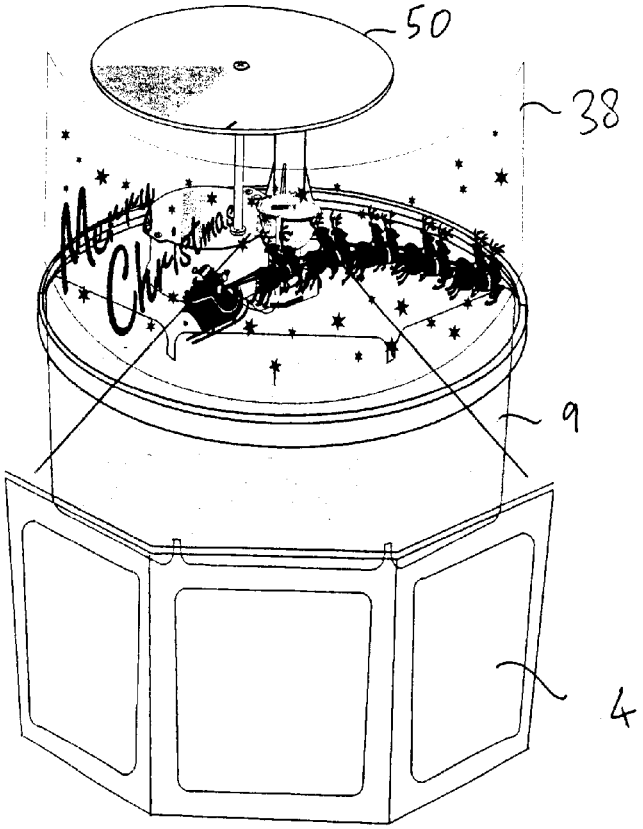
FIG. 5 shows the projection of the images onto screens.
Figure 5:
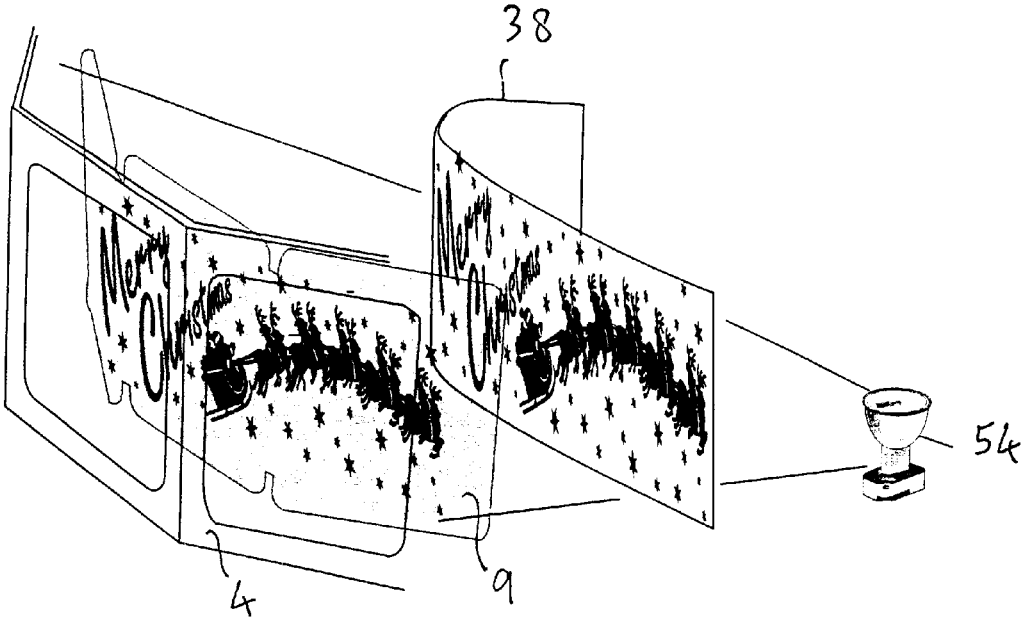
Figure 6:
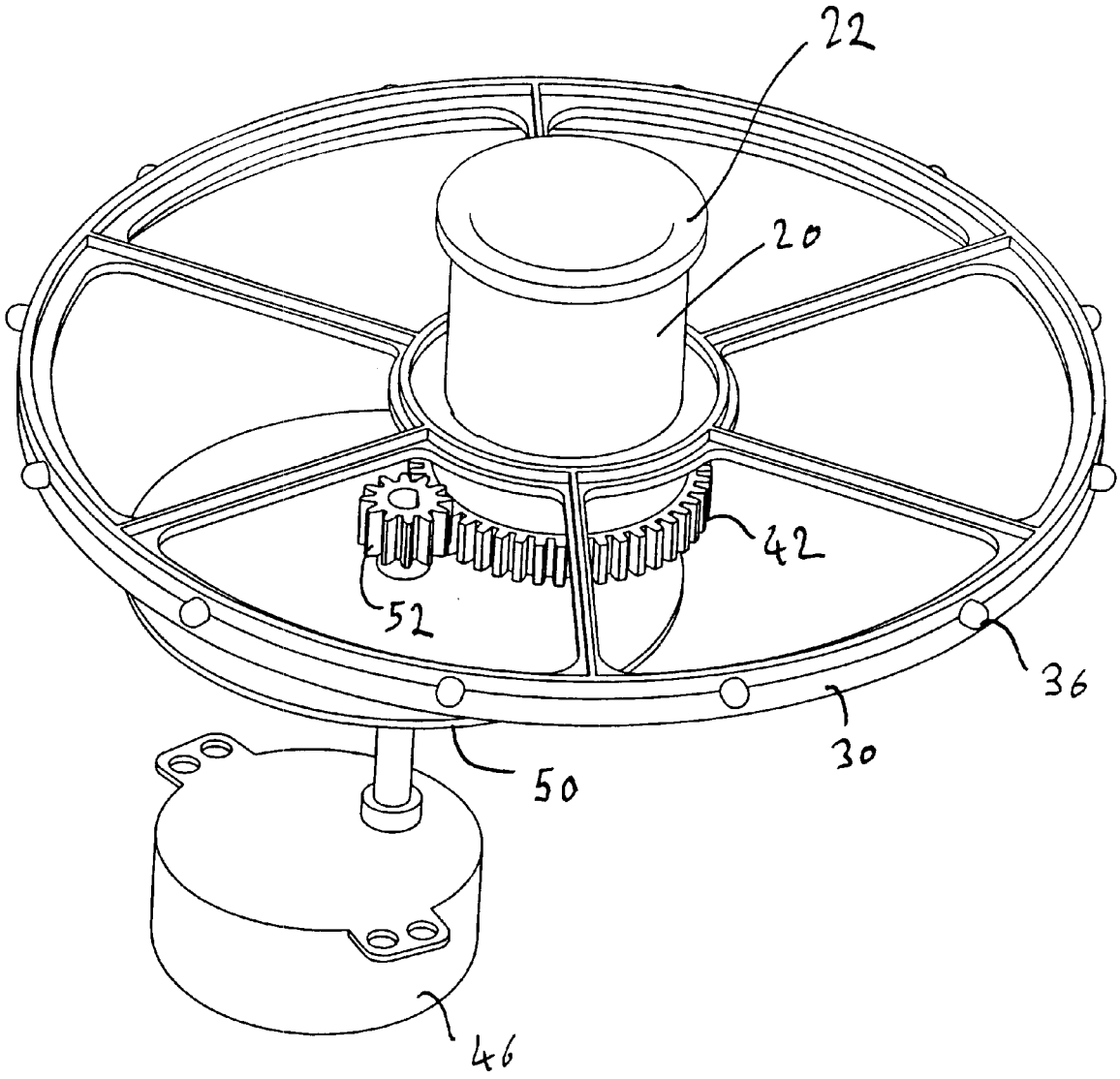
FIG. 6 shows a motor and drive assembly.
Figure 7:
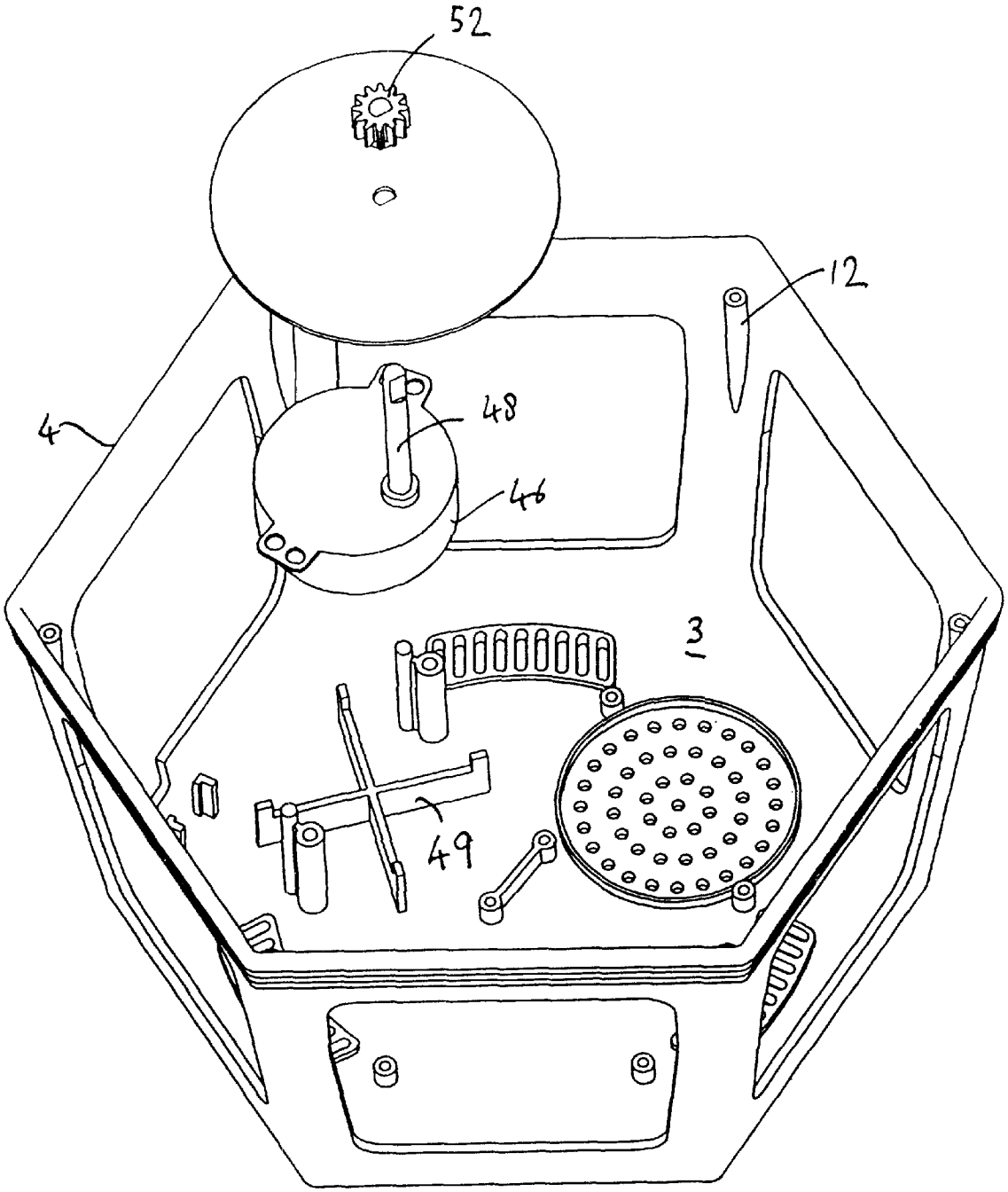
FIG. 7 shows part of the interior of the housing when partly disassembled.
Figure 8:
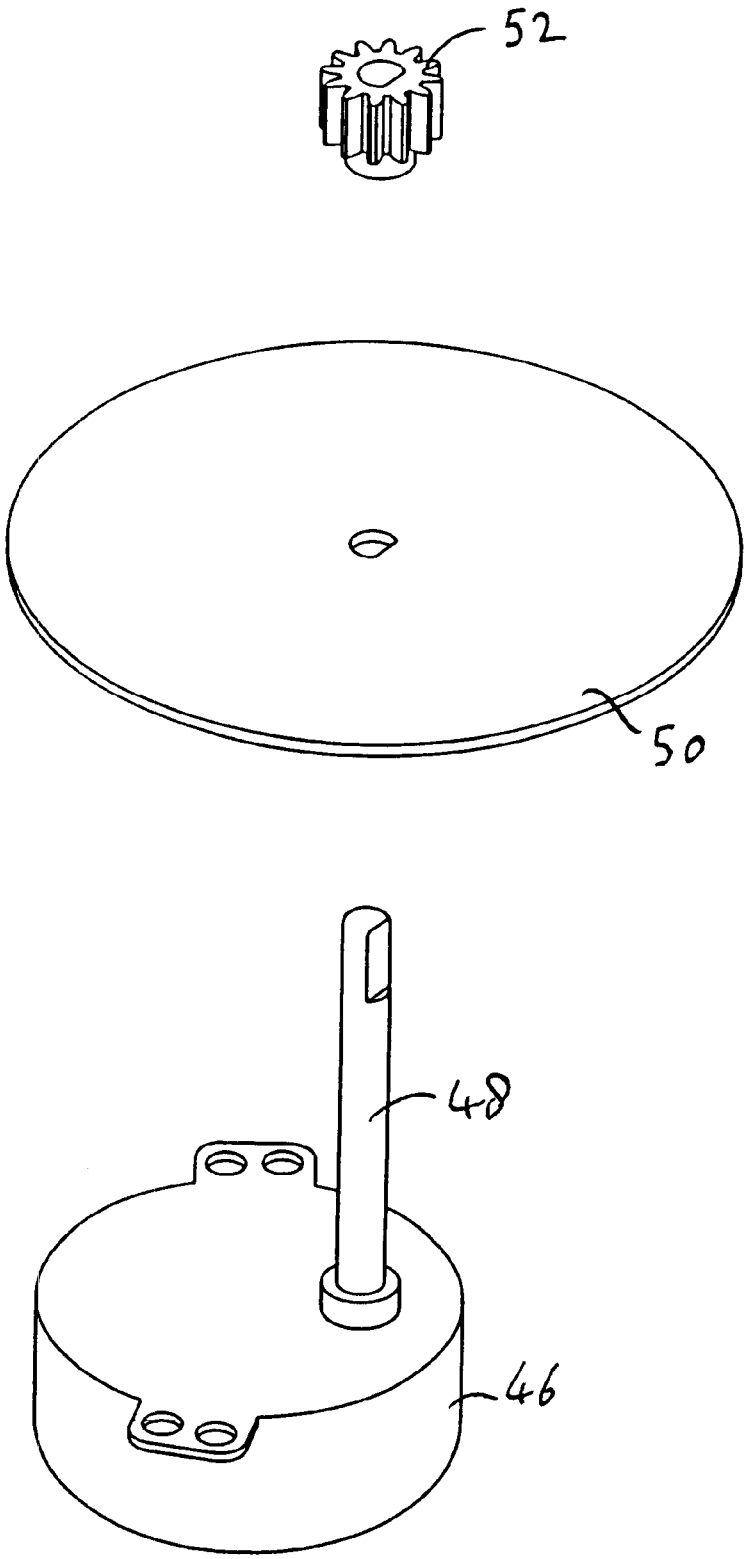
FIG. 8 shows the motor and a colour wheel.

Supported on the sleeve 20 is a wheel 30 having a central opening 32 through which the sleeve extends provided with oppositely-disposed recesses 34 into which the ribs 28 of the sleeve can engage to provide a positive drive therebetween. The wheel 30 is provided at its outer periphery with a plurality of protrusions 36. Supported on the wheel 30 is a sheet of transparency 38 in the form of a tube of transparent plastics film which carries a decorative image such as is shown for example in FIG. 5. The transparency 38 may be cut from a single strip of film and bent into the tubular shape with the edges secured by clear adhesive or clear adhesive tape or similar. At an upper edge the tube is provided with a plurality of openings 40 by which it is secured on the wheel 30, the protrusions 36 entering into respective openings 40.

As an alternative to the image-bearing film the wheel 30 can carry a number of cut-out shapes or objects of decorative shape which thereby produce shadows on the screens.

Also carried on the sleeve 20 is a gear ring 42 having at its outer periphery a series of teeth. The gear ring 42 also has a pair of oppositely-disposed recesses 44 into which the ribs 28 of the sleeve fit to thereby provide a positive drive between the gear ring 42 and sleeve 20.

An electric motor 46 is arranged within the stand 2, being secured on a cross-shaped stand part 49 moulded on the base 3. A motor shaft 48 extends upwardly from the motor 46 and carries a colour wheel 50 and above this a gear 52 which meshes with the gear ring 42. The colour wheel 50 is a light-translucent disc of plastics material which may carry sections having a variety of different colours. The colour wheel 50 has a D-shaped central aperture which fits over a corresponding-shaped end portion of the shaft 48, thereby providing positive drive therebetween. Likewise, the gear wheel 52 has a D-shaped opening, again keying it to the shaft 48. When the motor 46 is operated so that the shaft 48 rotates it thereby rotates both the colour wheel 50 and gear wheel 52, which in turn drives the ring 42, wheel 30 and sleeve 20 in rotation. Although not shown in the Figures, the sleeve 20 supports the lower end of the trunk of an artificial Christmas tree, such that when the motor is operated the tree also rotates.

Figure 9:
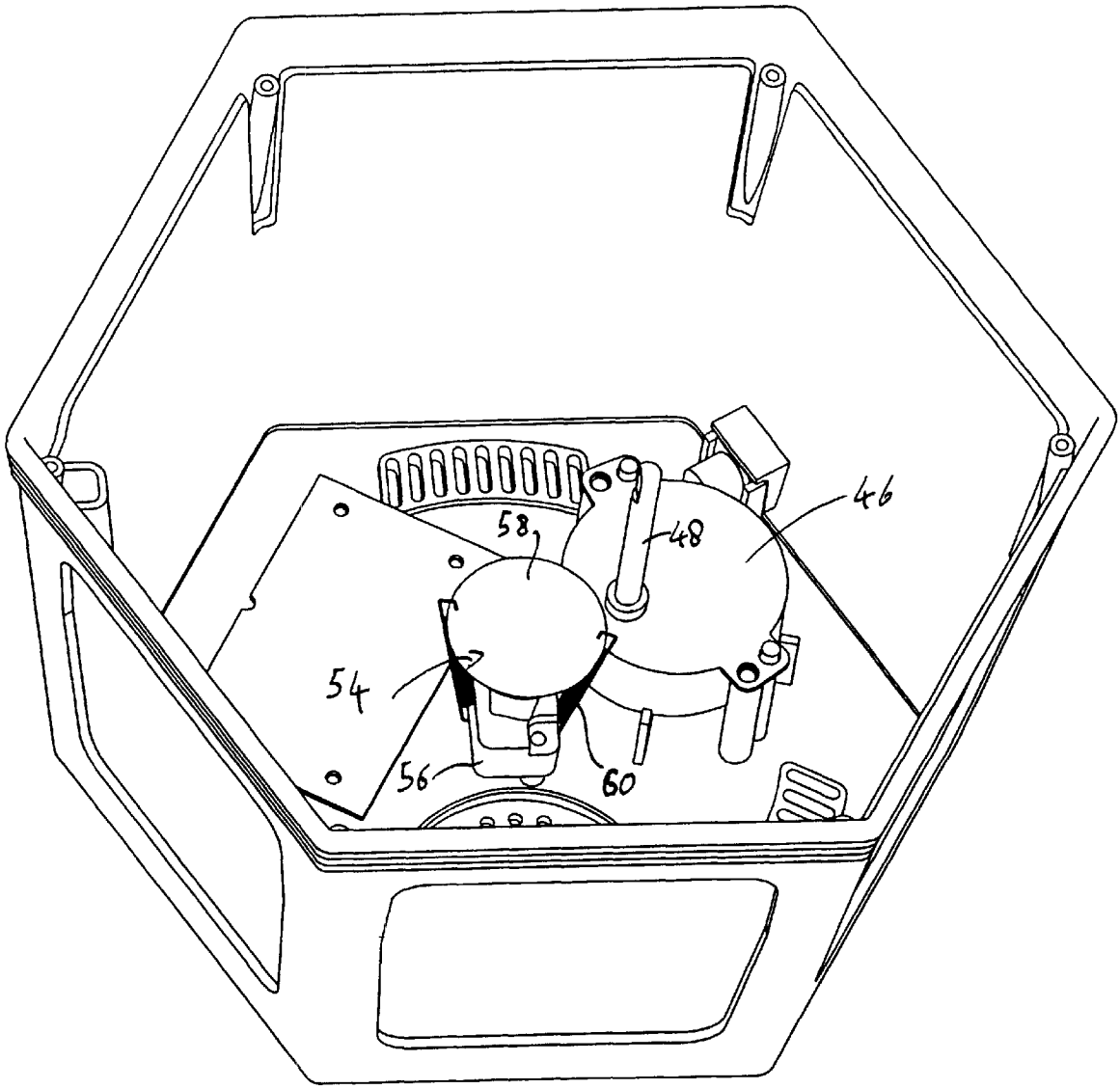
FIG. 9 shows a part of the interior of the housing partly disassembled.

As can be in FIG. 9, adjacent the motor 46 is a lamp 54 having a socket 56 and halogen-type bulb 58 which is reliably held in the socket by means of spring 60. Light from the lamp 54 is directed both upwardly at the sleeve 20 through the colour wheel thereby illuminating the base of the trunk of the artificial Christmas tree and, specifically, the ends of the bundles of optical fibres which carry the light along the tree branches, and also although less brightly laterally onto the transparency 38 thereby projecting images in the transparency 38 onto the screens 9. As the transparency 38 is rotated the projected image thereby rotates over the screens 9.

Figure 10:
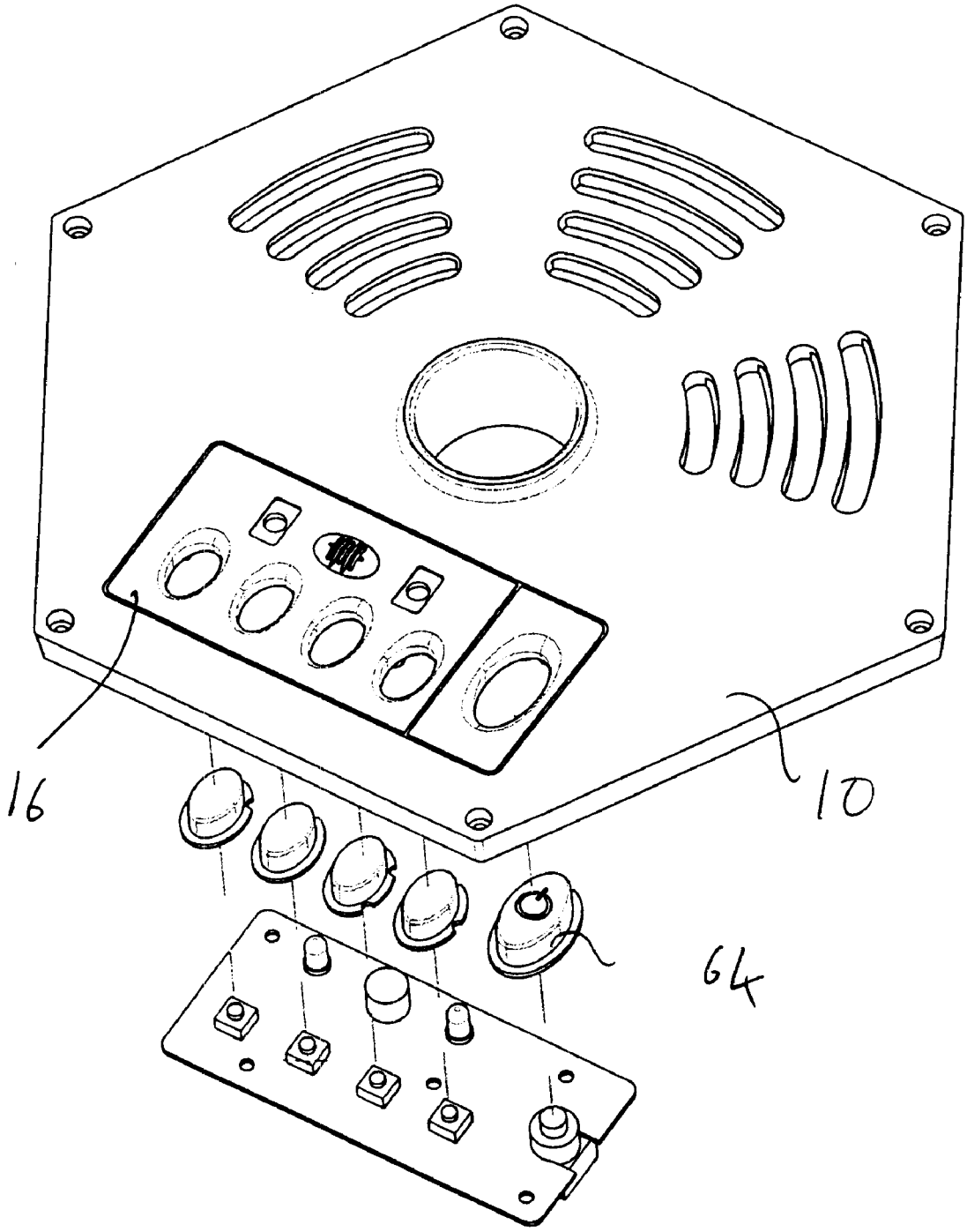
FIG. 10 shows the top plate and control panel.
Figure 11:
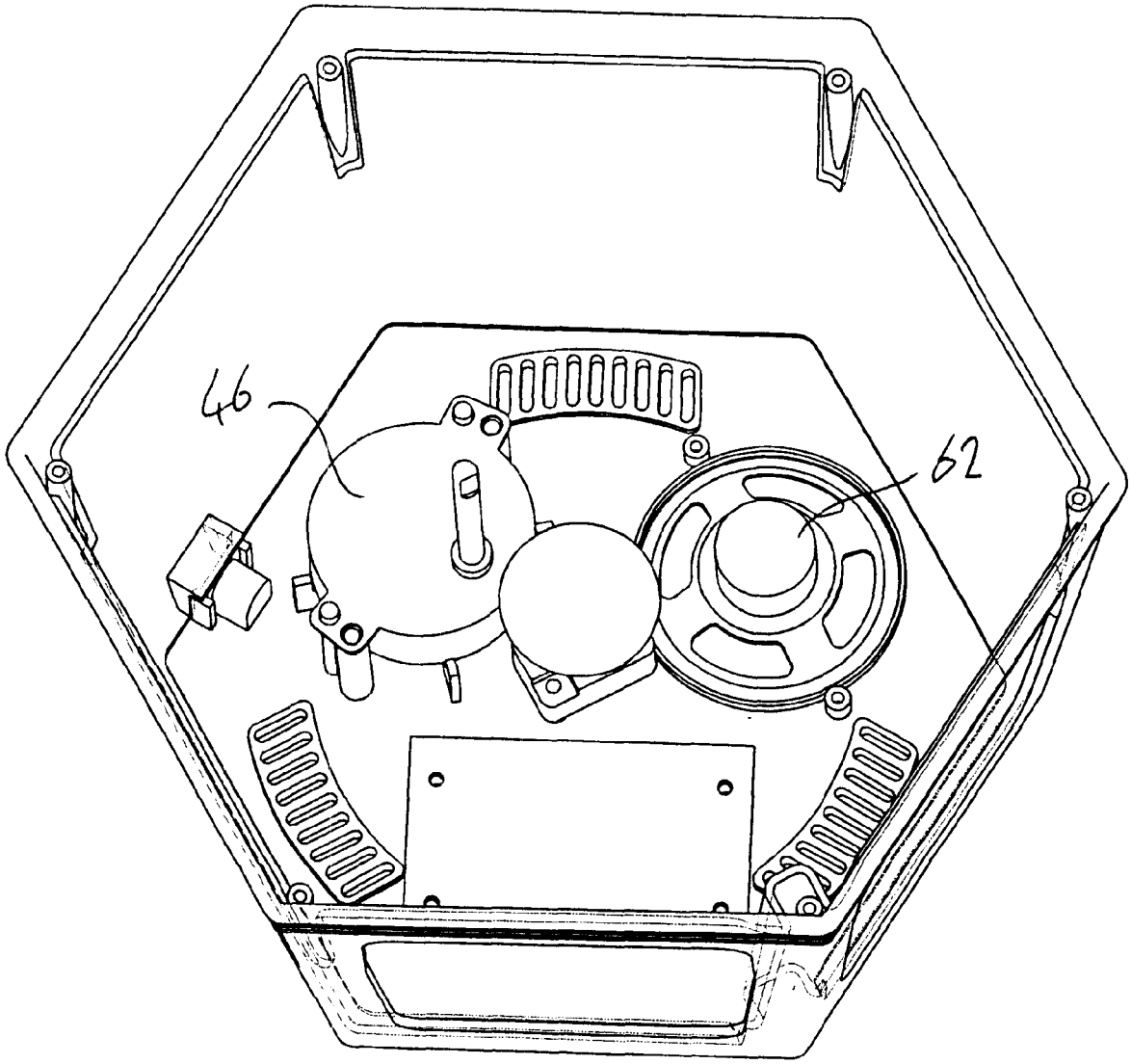
FIG. 11 is a further view of the interior of the housing.
Figure 12:
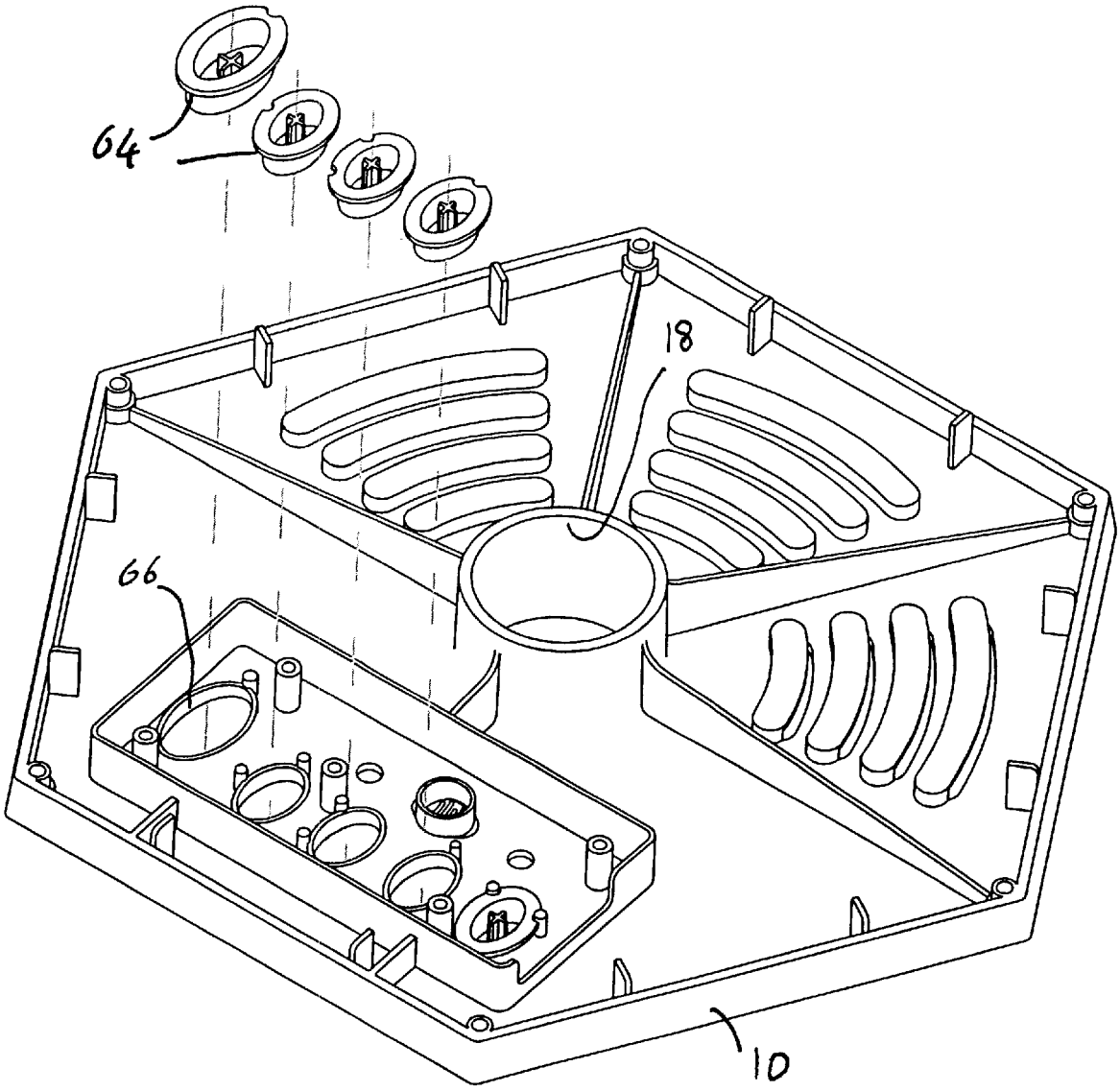
FIG. 12 is a view of the underside of the top plate.

Also disposed within the stands is means for generating a number of musical tunes, including a printed circuit board having a conventional musical-generating circuit or chip. This may have a number of different musical tunes, for example 10 musical sequences, stored therein which the user can select as desired. Supported on the based 3 is a cone speaker 62 at which the sound is generated as driven by the sound-producing circuit. Also provided is a sound-recording means in the form of a microphone and conventional recording chip which allows the user to record a short message, greeting or piece of music or similar. A series of LED's may provide the user with an acknowledgement of when a recording has been made. The control panel 16 carries a plurality of buttons which control the on-off function, music-playing functions, recording facilities etc. The buttons 64 protrude through openings 66 in the panel 16, being fitted from below as can be seen in FIGS. 10 and 12.

Although not shown, an external socket is provided for electrical connection to an external power supply such as mains 240 v or 110 v ac through a transformer which provides 12 v supply to the stand.

What is claimed is:

1. A stand for supporting an artificial tree of a type having a plurality of optical fibres which extend to a lower end of a trunk of the tree, the stand comprising a housing, a trunk supporting member which, in use, receives the end of the trunk of a tree, an internal light source in the housing, one or more screens supported on the housing and a decorative image-carrying medium between the light source and the screen or screens, the light source being arranged to illuminate, in use, both the screen or screens and optical fibre ends when the trunk is supported in the supporting member.

2. A stand according to claim 1 wherein the image carrying medium is a sheet of transparent material bearing a decorative image thereon.

3. A stand according to claim 2 wherein the sheet of transparent material is supported so as to be rotatable within the housing.

4. A stand according to claim 1 wherein the or each screen comprises a sheet of light translucent material having a light-diffusing surface.

5. A stand according to claim 1 wherein the trunk supporting member is mounted for rotation and wherein a motor is provided which is operably connected to the supporting member to drive this in rotation.

6. A stand according to claim 3 wherein the sheet of image bearing transparent material is supported at the periphery of a wheel.

7. A stand according to claim 6 wherein the wheel has a plurality of protrusions, and wherein the sheet of image-bearing material has a plurality of openings which receive the protrusions of the transparent sheet.

8. A stand according to claim 6 wherein the wheel is connected to the trunk supporting member.

9. A stand according to claim 1 wherein there is additionally provided an electronic music-generating means.

10. A stand according to claim 1 wherein there is additionally provided an electronic sound recording and play-back means.

11. A stand for supporting an artificial tree of a type having a plurality of optical fibres which extend to a lower end of a trunk of the tree, the stand comprising:

(a) a housing having a base and a sidewall defining one or more windows;

(b) a screen member in each window;

(c) an internal light source;

(d) a decorative image-bearing material or shape arranged between the light source and the screen members; and (d) a tree trunk supporting member; the internal light source being directed at the trunk supporting member to illuminate the optical fibre ends of the trunk when the trunk is supported in use in the tree trunk supporting member and arranged to illuminate the image-bearing material and the screen members.

12. A stand for supporting an artificial tree of a type having a plurality of optical fibres, the stand comprising a housing, a trunk supporting member which, in use, receives the end of the trunk of a tree, an internal light source in the housing, one or more screens supported on the housing and a decorative image-carrying medium in the form of a sheet of transparent material bearing a decorative image thereon between the light source and the screen or screens, a wheel rotatably mounted within the housing having a periphery at which the image-carrying medium is supported, wherein the wheel has a plurality of protrusions, and wherein the sheet of image-bearing material has a plurality of openings which receive the protrusions of the transparent sheet.

13. A stand according to claim 12 wherein the wheel is connected to the trunk supporting member.

14. A stand according to claim 12 wherein the trunk supporting member is mounted for rotation and wherein a motor is provided which is operably connected to the supporting member to drive this in rotation.

15. A stand according to claim 14 wherein a translucent colour wheel is disposed between the light source and trunk supporting member which is rotatably driven by the motor.

16. A stand for supporting an artificial tree of a type having a plurality of optical fibres, the stand comprising a housing, a trunk supporting member which, in use, receives the end of the trunk of a tree, an internal light source in the housing, one or more screens supported on the housing, a decorative image-carrying medium between the light source and the screen or screens, an electronic sound recording and play-back means.

* * * * *